US010770090B2

(12) United States Patent
Lee et al.

(10) Patent No.: US 10,770,090 B2
(45) Date of Patent: Sep. 8, 2020

(54) METHOD AND DEVICE OF AUDIO SOURCE SEPARATION

(71) Applicant: Realtek Semiconductor Corp., HsinChu (TW)

(72) Inventors: Ming-Tang Lee, Taoyuan (TW); Chung-Shih Chu, Hsinchu (TW)

(73) Assignee: Realtek Semiconductor Corp., HsinChu (TW)

( * ) Notice: Subject to any disclaimer, the term of this patent is extended or adjusted under 35 U.S.C. 154(b) by 531 days.

(21) Appl. No.: 15/611,799

(22) Filed: Jun. 2, 2017

(65) Prior Publication Data

US 2017/0352362 A1 Dec. 7, 2017

(30) Foreign Application Priority Data

Jun. 3, 2016 (TW) ..... 105117508 A

(51) Int. Cl.
*G10L 21/0272* (2013.01)
*G10L 19/008* (2013.01)
*G10L 21/02* (2013.01)

(52) U.S. Cl.
CPC ..... *G10L 21/0272* (2013.01); *G10L 19/008* (2013.01); *G10L 21/0205* (2013.01)

(58) Field of Classification Search
CPC ..... G10L 21/0272; G10L 21/0205; G10L 19/008
See application file for complete search history.

(56) References Cited

U.S. PATENT DOCUMENTS

2010/0217590 A1* 8/2010 Nemer ..... G01S 3/8006 704/233

OTHER PUBLICATIONS

Ortega-Garcia et al., "Overview of speech enhancement techniques for automatic speaker recognition", 1996.

(Continued)

*Primary Examiner* — Alexander Satanovsky
*Assistant Examiner* — Mark I Crohn
(74) *Attorney, Agent, or Firm* — Winston Hsu

(57) ABSTRACT

A method of audio source separation includes steps of applying a demixing matrix on a plurality of received signals to generate a plurality of separated results; performing a recognition operation on the plurality of separated results to generate a plurality of recognition scores; generating a constraint according to the plurality of recognition scores; and adjusting the demixing matrix according to the constraint; where the adjusted demixing matrix is applied to the plurality of received signals to generate a plurality of updated separated results from the plurality of received signals.

20 Claims, 10 Drawing Sheets

(56) References Cited

OTHER PUBLICATIONS

McCowan et al., "Robust speaker recognition using microphone arrays", 2001.
Gonzalez-Rodriguez et al.,"Robust speaker recognition through acoustic array processing and spectral normalization", 1997.
Lleida et al., "Robust continuous speech recognition system based on a microphone array", Research Gate, Acoustics, Speech and Signal Processing, 1998. Proceedings of the 1998 IEEE International Conference on, vol. 1, Jun. 1998.
Knaak et al., "Geometrically constrained independent component analysis", IEEE Transactions on Audio, Speech, and Language Processing, vol. 15, No. 2,Feb. 2007, p. 715-726.
Nesta et al., "Blind source extraction for robust speech recognition in multisource noisy environment", Computer Speech and Language, 27(2013), p. 703-725, 2013, 2012 Elsevier Ltd.
Harry L. Van Trees, "Optimum array processing—Part IV of detection, estimation, and modulation theory", 2002 John Wiley & Sons, Inc., p. 710-712, 2002.

* cited by examiner

METHOD AND DEVICE OF AUDIO SOURCE SEPARATION

BACKGROUND OF THE INVENTION

1. Field of the Invention

The present invention relates to a method and a device of audio source separation, and more particularly, to a method and a device of audio source separation capable of being adaptive to a spatial variation of a target signal.

2. Description of the Prior Art

Speech input/recognition is widely exploited in electronic products such as mobile phones, and multiple microphones are usually utilized to enhance performance of speech recognition. In a speech recognition system with multiple microphones, an adaptive beamformer technology is utilized to perform spatial filtering to enhance audio/speech signals from a specific direction, so as to perform speech recognition on the audio/speech signals from the specific direction. An estimation of direction-of-arrival (DoA) corresponding to the audio source is required to obtain or modify a steering direction of the adaptive beamformer. A disadvantage of the adaptive beamformer is that the steering direction of the adaptive beamformer is likely incorrect due to a DoA estimation error. In addition, a constrained blind source separation (CBSS) method is proposed in the art to generate the demixing matrix, which is able/utilized to separate a plurality of audio sources from signals received by a microphone array. The CBSS method is also able to solve a permutation problem among the separated sources of a conventional blind source separation (BSS) method. However, a constraint of the CBSS method in the art is not able to be adaptive to a spatial variation of the target signal(s), which degrades performance of target source separation. Therefore, it is necessary to improve the prior art.

SUMMARY OF THE INVENTION

It is therefore a primary objective of the present invention to provide a method and a device of audio source separation capable of being adaptive to a spatial variation of a target signal, to improve over disadvantages of the prior art.

An embodiment of the present invention discloses a method of audio source separation, configured to separate audio sources from a plurality of received signals. The method comprises steps of applying a demixing matrix on the plurality of received signals to generate a plurality of separated results; performing a recognition operation on the plurality of separated results to generate a plurality of recognition scores, wherein the plurality of recognition scores is related to a matching degree between the plurality of separated results and a target signal; generating a constraint according to the plurality of recognition scores, wherein the constraint is a spatial constraint or a mask constraint; and adjusting the demixing matrix according to the constraint; wherein the adjusted demixing matrix is applied to the plurality of received signals to generate a plurality of updated separated results from the plurality of received signals.

An embodiment of the present invention further discloses an audio separation device, configured to separate audio sources from a plurality of received signals. The audio separation device comprises a separation unit, for applying a demixing matrix on the plurality of received signals to generate a plurality of separated results; a recognition unit, for performing a recognition operation on the plurality of separated results to generate a plurality of recognition scores, wherein the plurality of recognition scores is related to a matching degree between the plurality of separated results and a target signal; a constraint generator, for generating a constraint according to the plurality of recognition scores, wherein the constraint is a spatial constraint or a mask constraint; and a demixing matrix generator, for adjusting the demixing matrix according to the constraint; wherein the adjusted demixing matrix is applied to the plurality of received signals to generate a plurality of updated separated results from the plurality of received signals.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
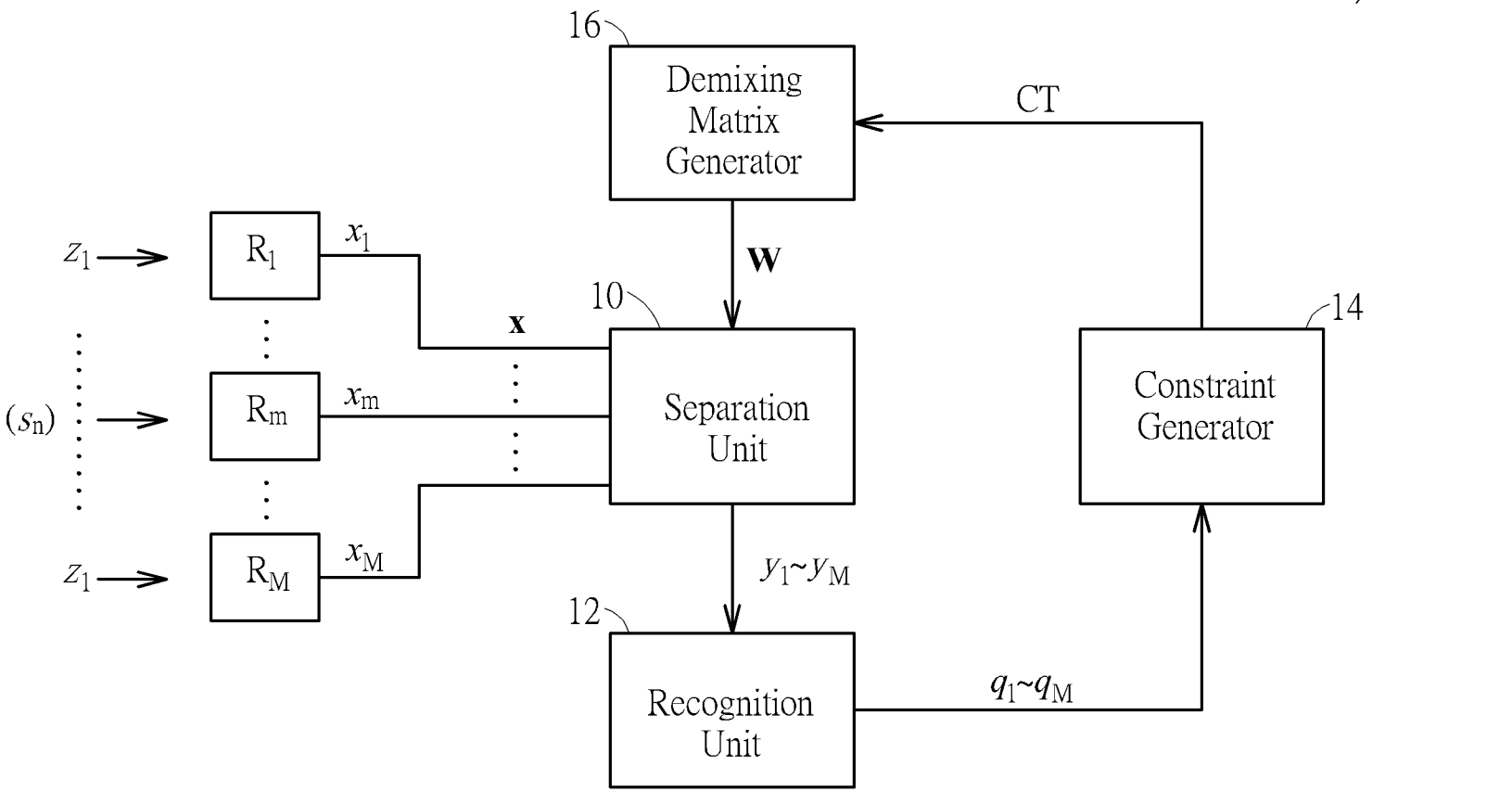
FIG. 1 is a schematic diagram of an audio source separation device according to an embodiment of the present invention.

FIG. 1 is a schematic diagram of an audio source separation device 1 according to an embodiment of the present invention. The audio source separation device 1 may be an application specific integrated circuit (ASIC) , configured to separate audio sources $z_1$- $z_M$ from received signals $x_1$-$x_M$. Target signals $s_1$-$s_N$ may be speech signals and exist within the audio sources $z_1$-$z_M$. The audio sources $z_1$-$z_M$ may have various types. For example, the audio sources $z_1$-$z_M$ may be background noise, echo, interference or speech from speaker(s). In embodiments of the present invention, the target signals $s_1$-$s_N$ may be speech signals from a target speaker for a specific speech content. Hence, in an environment with the audio sources $z_1$-$z_M$, the target signals $s_1$-$s_N$ do not always exist. For illustrative purpose, the following description is under an assumption that there is only one single target signal $s_n$. The audio source separation device 1 may be applied for speech recognition or speaker recognition, which comprises receivers $R_1$-$R_M$, a separation unit 10, a recognition unit 12, a constraint generator 14 and a demixing matrix generator 16. The receivers $R_1$-$R_M$ may be microphones, which receive received signals $x_1$-$x_M$ and deliver the received signals $x_1$-$x_M$ to the separation unit 10. The received signals $x_1$-$x_M$ may be represented as a received signal set x, i.e., $x=[x_1, \ldots, x_M]^T$. The separation unit 10 is coupled to the demixing matrix generator 16. The separation unit 10 is configured to multiply the received signal set x by a demixing matrix W generated by the demixing matrix generator 16, so as to generate a separated result set y. The separated result set y comprises separated results $y_1$-$y_M$, i.e., $y[y_1, \ldots, y_M]^T=Wx$, wherein the separated results $y_1$-$y_M$, corresponding to the audio sources $z_1$-$z_M$, are separated from the received signals $x_1$-$x_M$. The recognition unit 12 is configured to perform a recognition operation on the separated results so as to generate recognition scores $q_1$-$q_M$, related to the matching degree corresponding to the target signal $s_n$, and deliver the recognition scores $q_1$-$q_M$ to the constraint generator 14. The higher the recognition scores $q_m$, the higher the matching degree (the more similar) between the separated result $y_m$ and the target signal $s_n$. The constraint generator 14 may generate a constraint CT according to the recognition scores $q_1$-$q_M$, and deliver the constraint CT to the demixing matrix generator 16, wherein the constraint CT is utilized as a control signal corresponding to a specific direction in a particular space. The demixing matrix generator 16 may generate a renewed/adjusted demixing matrix W according to the constraint CT. The adjusted demixing matrix W may then be applied to the received signals $x_1$-$x_M$ to separate the audio sources $z_1$-$z_M$. In an embodiment, the demixing matrix W may be generated by the demixing matrix generator 16 via a constrained blind source separation (CBSS) method.

Figure 10:
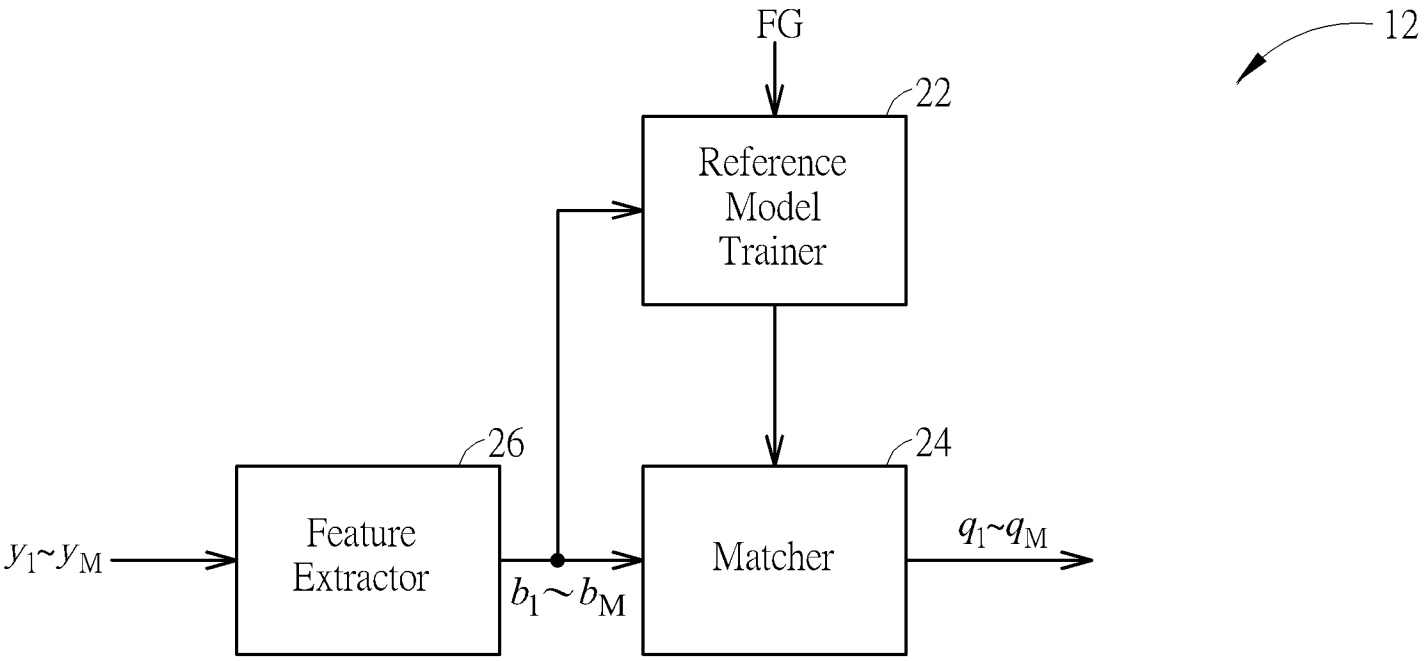
FIG. 10 is a schematic diagram of a recognition unit according to an embodiment of the present invention.

The recognition unit 12 may comprise a feature extractor 20, a reference model trainer 22 and a matcher 24, as shown in FIG. 10. The feature extractor 20 may generate feature signals $b_1$-$b_M$ according to the separated results $y_1$-$y_M$. Take speech recognition as an example, the feature extracted by the feature extractor 20 may be Mel-frequency cepstral coefficients (MFCC). When a training flag FG indicates that the recognition unit 12 is in a training phase, the feature extractor 20 extracts features related to the target signal $s_n$ from the separated results $y_1$-$y_M$, and delivers the features to the reference model trainer 22, so as to generate a reference model of the target signal $s_n$. On the other hand, when the training flag FG indicates that the recognition unit 12 is in a testing phase, the matcher 24 compares features extracted from the separated results $y_1$-$y_M$(in the testing phase) with the reference model, so as to generate the recognition scores $q_1$-$q_M$. In other words, the reference model trainer 22 may establish the reference model corresponding to the target signal $s_n$ during the training phase. Then, in the testing phase, the matcher compares the feature signals $b_1$-$b_M$ extracted by the feature extractor 20 (in the testing phase) with the reference model, to output the recognition scores $q_1$-$q_M$ and obtain the degree of similarity in between. Other details of the recognition unit 12 are known by the art, which are not narrated herein.

Figure 2:
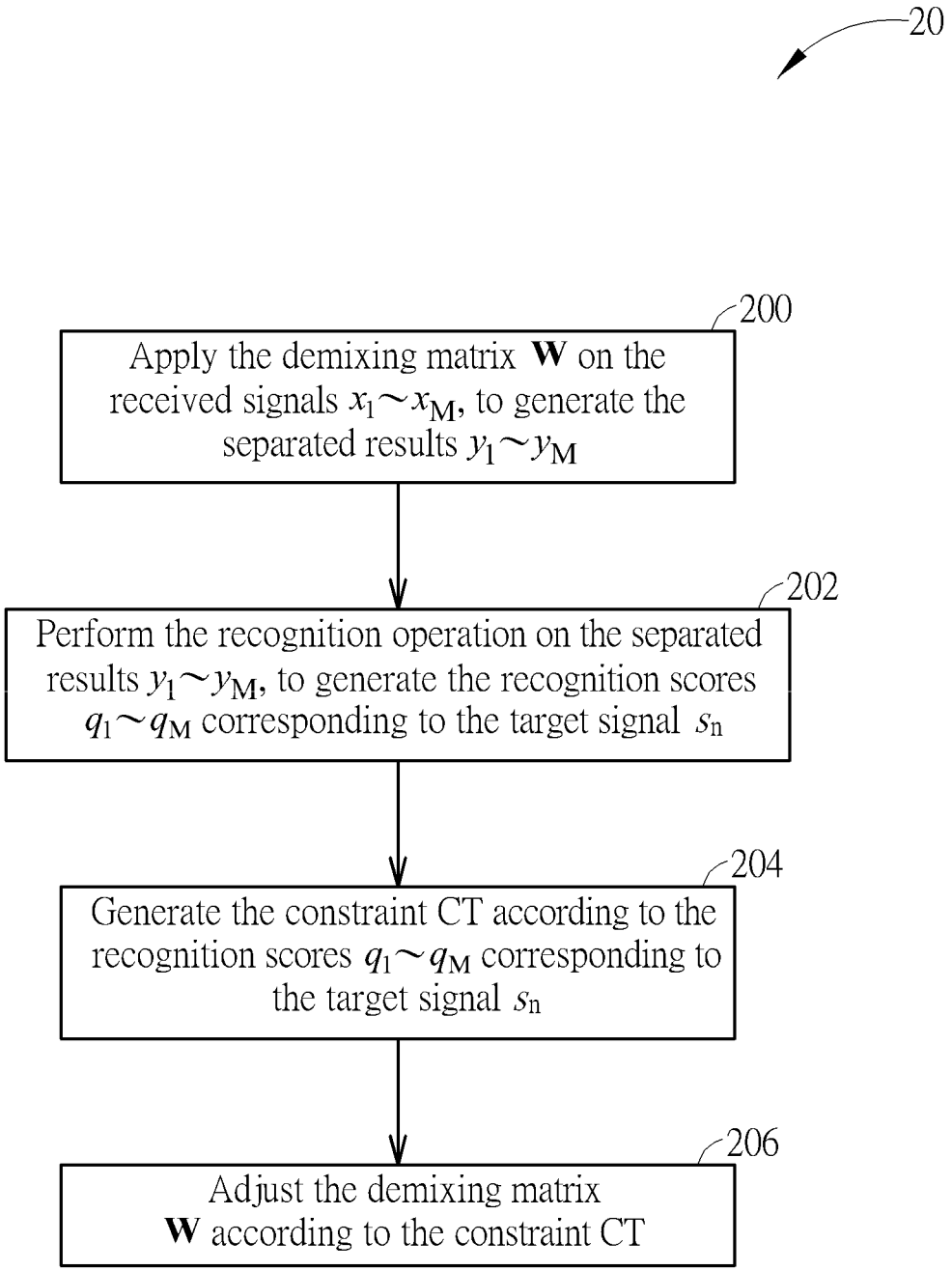
FIG. 2 is a schematic diagram of an audio source separation process according to an embodiment of the present invention.

In short, since the recognition scores $q_1$-$q_M$ may change with spatial characteristic of the target signal(s) related to the receivers $R_1$-$R_M$, the audio source separation device 1 generates different constraint CT, according to the recognition scores $q_1$-$q_M$ generated by the recognition unit 12 at different time instants, as a control signal corresponding to some specific direction in the space, and adjusting the demixing matrix W according to the updated constraint CT, so as to separate the audio sources $z_1$-$z_M$ more properly, and obtain the updated results $y_1$-$y_M$. Therefore, the constraint CT and the demixing matrix W generated by the audio source separation device 1 are adaptive in response to the spatial variation of the target signal(s), which improves performance of target source separation. Operations of the audio source separation device 1 may be summarized as an audio source separation process 20. As shown in FIG. 2, the audio source separation process 20 comprises the following steps:

Step 200: Apply the demixing matrix W on the received signals $x_1$-$x_M$, to generate the separated results $y_1$-$y_M$.

Step 202: Perform the recognition operation on the separated results $y_1$-$y_M$, to generate the recognition scores $q_1$-$q_M$ corresponding to the target signal $s_n$.

Step 204: Generate the constraint CT according to the recognition scores $q_1$-$q_M$ corresponding to the target signal $s_n$.

Step 206: Adjust the demixing matrix W according to the constraint CT.

In an embodiment, the constraint generator 14 may generate the constraint CT as a spatial constraint c, and the demixing matrix generator 16 may generate the renewed demixing matrix W according to the spatial constraint c. The spatial constraint c may be configured to limit a response of the demixing matrix W along with a specific direction in the space, such that the demixing matrix W has a spatial filtering effect on the specific direction. Methods of the demixing matrix generator 16 generating the demixing matrix W according to the spatial constraint c are not limited. For example, the demixing matrix generator 16 may generate the demixing matrix W such that $w_m^H c=c_1$, where $c_1$ may be an arbitrary constant, and $w_m^H$ represents a row vector of the demixing matrix W (i.e., the demixing matrix W may be represented as $$W = \begin{bmatrix} w_1^H \\ \vdots \\ w_M^H \end{bmatrix}.$$

Figure 3:
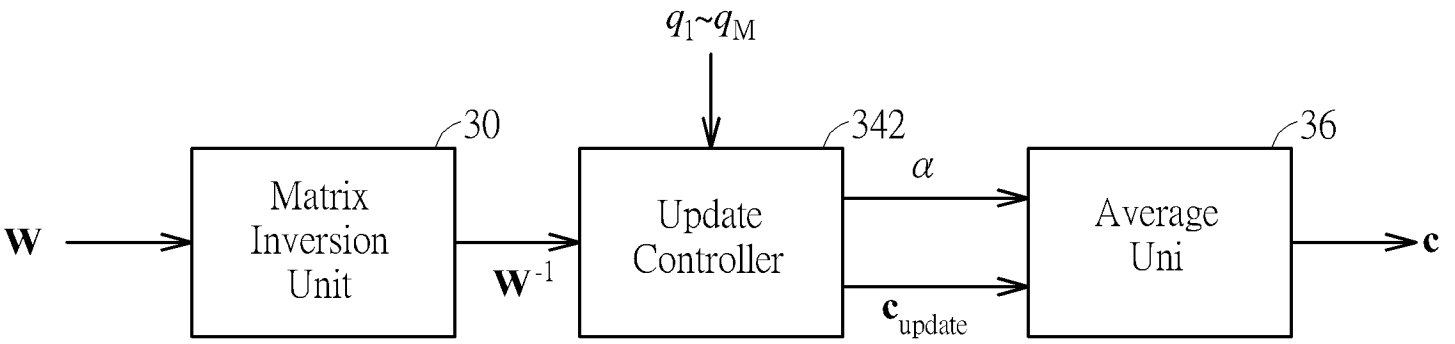
FIG. 3 is a schematic diagram of a constraint generator according to an embodiment of the present invention.
Figure 4:
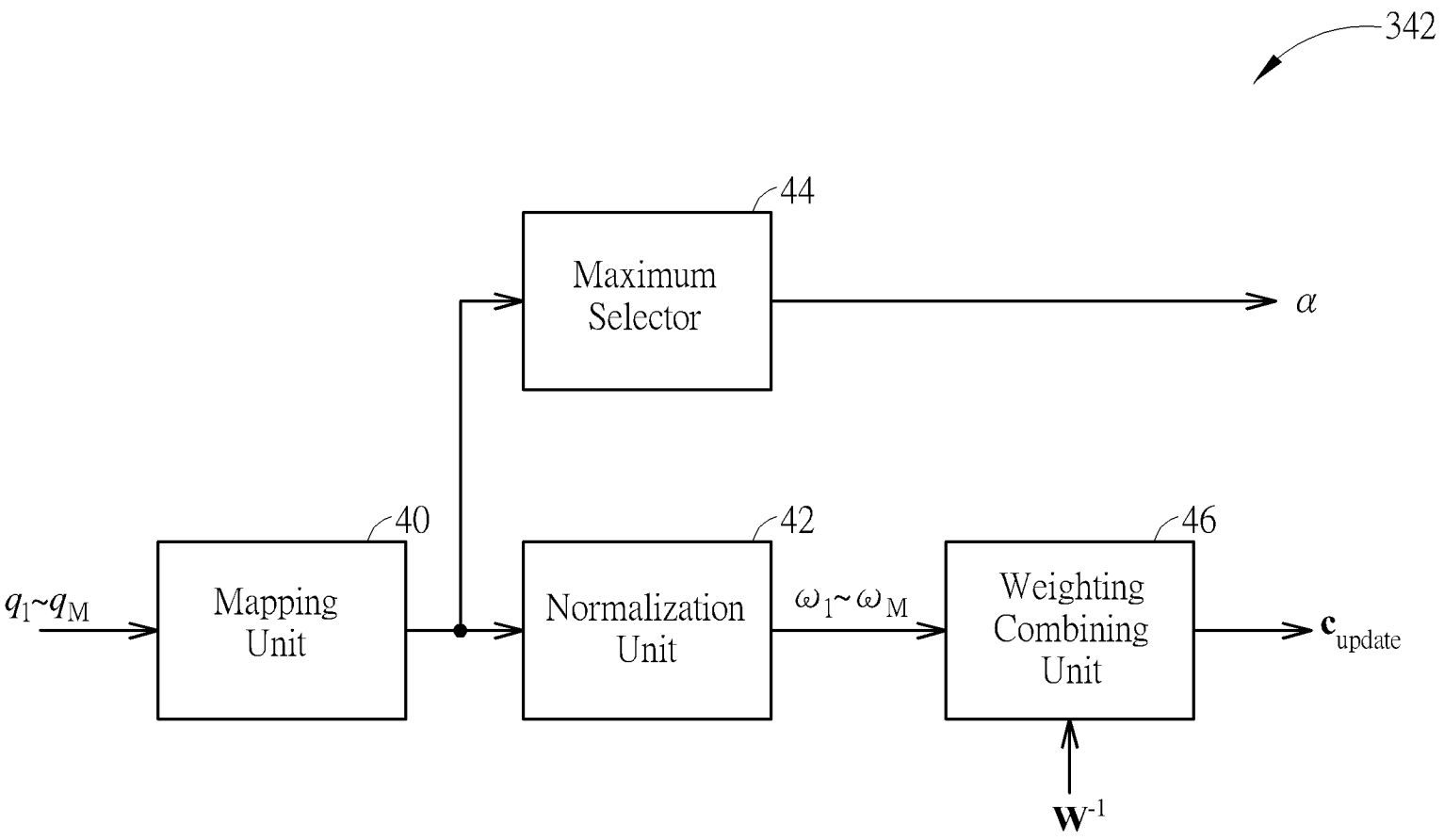
FIG. 4 is a schematic diagram of an update controller according to an embodiment of the present invention.

In detail, FIG. 3 and FIG. 4 are schematic diagrams of a constraint generator 34 and an update controller 342 according to an embodiment of the present invention. The constraint generator 34 may generate the spatial constraint c according to the demixing matrix W and the recognition scores $q_1$-$q_M$, which comprises the update controller 342, a matrix inversion unit 30 and an average unit 36. The update controller 342 comprises a mapping unit 40, a normalization unit 42, a maximum selector 44 and a weighting combining unit 46. The matrix inversion unit 30 is coupled to the demixing matrix generator 16 to receive the demixing matrix W, and performs a matrix inversion operation on the demixing matrix W, to generate an estimated mixing matrix $W^{-1}$. The update controller 342 generates an update rate $\alpha$ and an update coefficient $c_{update}$ according to the estimated mixing matrix $W^{-1}$ and the recognition scores $q_1$-$q_M$, and the average unit 36 generates the spatial constraint c according to the update rate $\alpha$ and the update coefficient $c_{update}$.

Specifically, the estimated mixing matrix $W^{-1}$ may represent an estimate of a mixing matrix H. The mixing matrix H represents corresponding relationship between the audio sources $z_1$-$z_M$ and the received signals $x_1$-$x_M$, i.e., $x=Hz$ and $z=[z_1, \ldots, z_M]^T$. The mixing matrix H comprises steering vectors $h_1$-$h_M$, i.e. , $H=[h_1 \ldots h_M]$. In other words, the estimated mixing matrix $w^{-1}$ comprises estimated steering vectors $\hat{h}_1$-$\hat{h}_M$, which may be represented as $W^{-1}=[\hat{h}_1 \ldots \hat{h}_M]$. In addition, the update controller 342 may generate weightings $\omega_1$-$\omega_M$ according to the recognition scores $q_1$-$q_M$, and generate the update coefficient $c_{update}$ as $$c_{update} = \sum_{m=1}^{M} \omega_m \hat{h}_m.$$

In addition, the update controller 342 performs a mapping operation on the recognition scores $q_1$-$q_M$ via the mapping unit 40, which is to map the recognition scores $q_1$-$q_M$ onto an interval between 0 and 1, linearly or nonlinearly, to generate mapping values $\tilde{q}_1$-$\tilde{q}_M$ corresponding to the recognition scores $q_1$-$q_M$ (each of the mapping values $\tilde{q}_1$-$\tilde{q}_M$ is between 0 and 1). Further, the update controller 342 performs a normalization operation on the mapping values $\tilde{q}_1$-$\tilde{q}_M$ via the normalization unit 42, to generate the weightings $\omega_1$-$\omega_M$ $$\left(\text{i.e., } \omega_m = \tilde{q}_m \Big/ \sum_{n=1}^{M} \tilde{q}_n\right).$$

In addition, the update controller 342 may generate the update rate $\alpha$ as a maximum value among the mapping values $\tilde{q}_1$-$\tilde{q}_M$ via the maximum selector 44, i.e., $\alpha=\max_m \tilde{q}_m$ . Therefore, the update controller 342 may output the update rate $\alpha$ and the update coefficient $c_{update}$ to the average unit 36, and the average unit 36 may compute the spatial constraint c as $c=(1-\alpha)c+\alpha c_{update}$. The constraint generator 34 delivers the spatial constraint c to the demixing matrix generator 16, and the demixing matrix generator 16 may generate the renewed demixing matrix W according to the spatial constraint c, to separate the audio sources $z_1$-$z_M$ even more properly.

Figure 5:
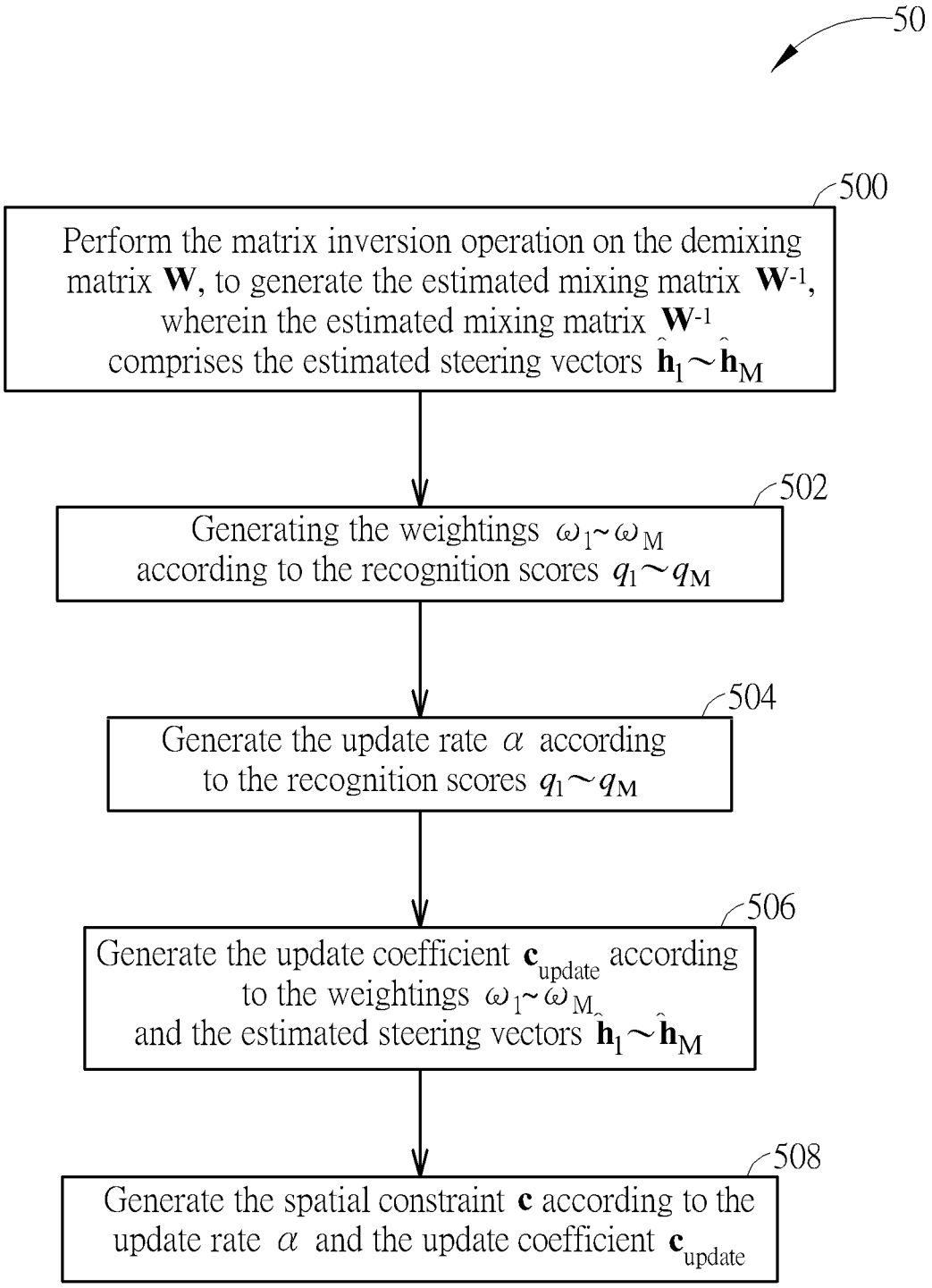
FIG. 5 is a schematic diagram of a spatial constraint generation process according to an embodiment of the present invention.

Operations of the constraint generator 34 may be summarized as a spatial constraint generation process 50, as shown in FIG. 5. The spatial constraint generation process 50 comprises the following steps:

Step 500: Perform the matrix inversion operation on the demixing matrix W, to generate the estimated mixing matrix $W^{-1}$, wherein the estimated mixing matrix $W^{-1}$ comprises the estimated steering vectors $\hat{h}_1$-$\hat{h}_M$.

Step 502: Generating the weightings $\omega_1$-$\omega_M$ according to the recognition scores $q_1$-$q_M$.

Step 504: Generate the update rate $\alpha$ according to the recognition scores $q_1$-$q_M$.

Step 506: Generate the update coefficient $c_{update}$ according to the weightings $\omega_1$-$\omega_M$ and the estimated steering vectors $\hat{h}_1$-$\hat{h}_M$.

Step 508: Generate the spatial constraint c according to the update rate $\alpha$ and the update coefficient $c_{update}$.

In another embodiment, the constraint generator 14 may generate the constraint CT as a mask constraint $\Lambda$, and the demixing matrix generator 16 may generate the renewed demixing matrix W according to the mask constraint $\Lambda$. The mask constraint $\Lambda$ may be configured to limit a response of the demixing matrix w toward a target signal, to have a masking effect on the target signal. Method of the demixing matrix generator 16 generating the demixing matrix w according to the mask constraint $\Lambda$ is not limited. For example, the demixing matrix generator 16 may use a recursive algorithm (such as a Newton method, a gradient method, etc.) to estimate an estimate of the mixing matrix H between the audio sources $z_1$-$z_M$ and the received signals $x_1$-$x_M$, and use the mask constraint $\Lambda$ to constraint a variation of the estimated mixing matrix from one iteration to the next iteration. In other words, the estimated mixing matrix $\hat{H}_{k+1}$, at the (k+1) -th iteration can be represented as $\hat{H}_{k+1}=\hat{H}_k+\Delta H\cdot\Lambda$, wherein the demixing matrix generator 16 may generate the demixing matrix W as $W=\hat{H}_{k+1}^{-1}$, and $\Delta H$ is related to the algorithm the demixing matrix generator 16 uses to generate the estimated mixing matrix $\hat{H}_{k+1}$. In addition, the mask constraint $\Lambda$ may be a diagonal matrix, which may perform a mask operation on an audio source $z_{n^*}$ among the audio sources $z_1$-$z_M$, where the audio source $z_{n^*}$ is regarded as the target signal $s_n$, and the index n* is regarded as the target index. In detail, the constraint generator 14 may set the n*-th diagonal element of the mask constraint $\Lambda$ as a specific value G, where the specific value G is between 0 and 1, and set the rest of diagonal elements as (1-G). That is, the i-th diagonal element $[\Lambda]_{i,i}$ of the mask constraint $\Lambda$ may be expressed as $$[\Lambda]_{i,i} = \begin{cases} G, & i = n^* \\ 1-G, & i \neq n^* \end{cases}.$$

Figure 6:
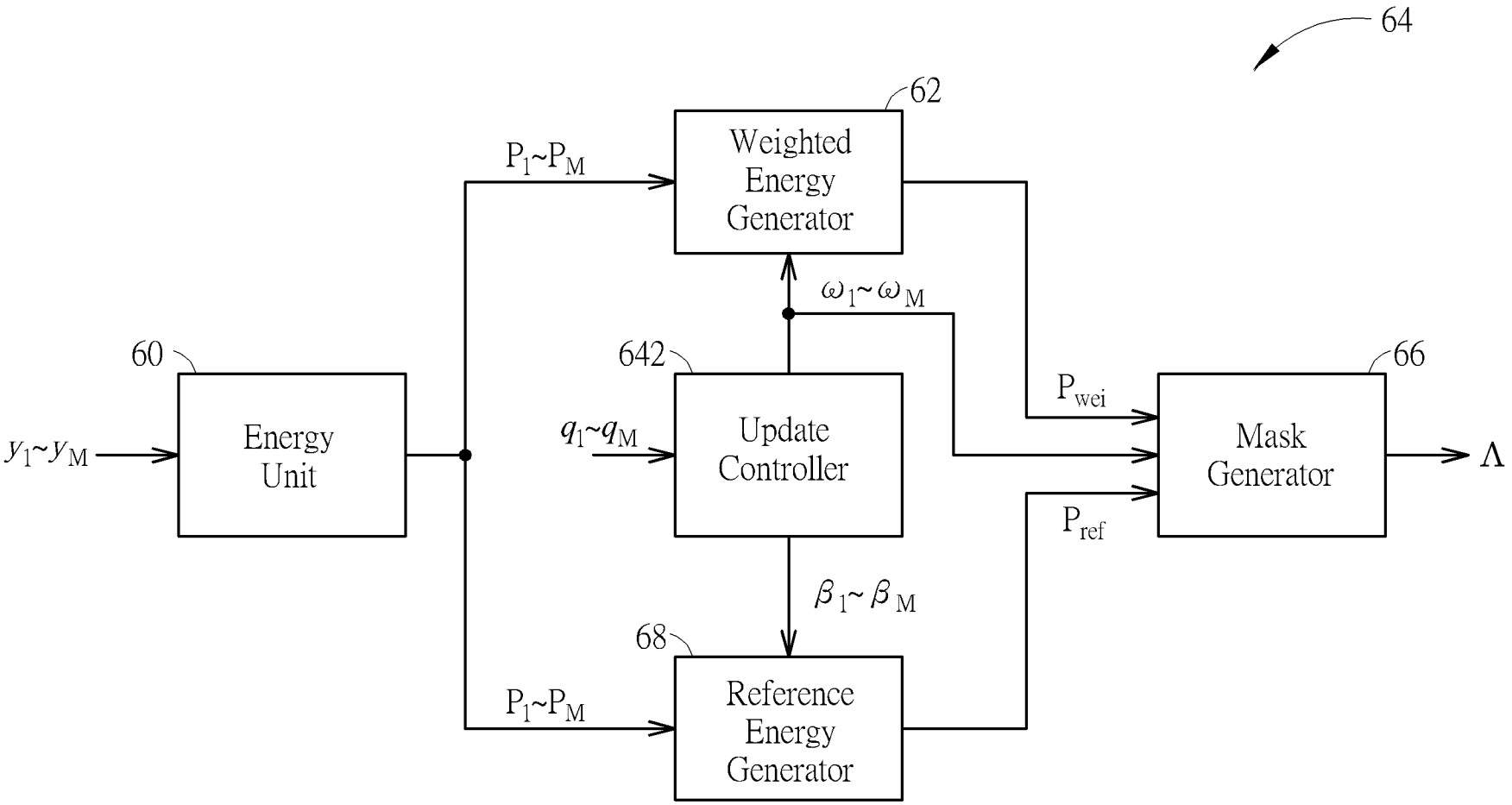
FIG. 6 is a schematic diagram of a constraint generator according to an embodiment of the present invention.
Figure 7:
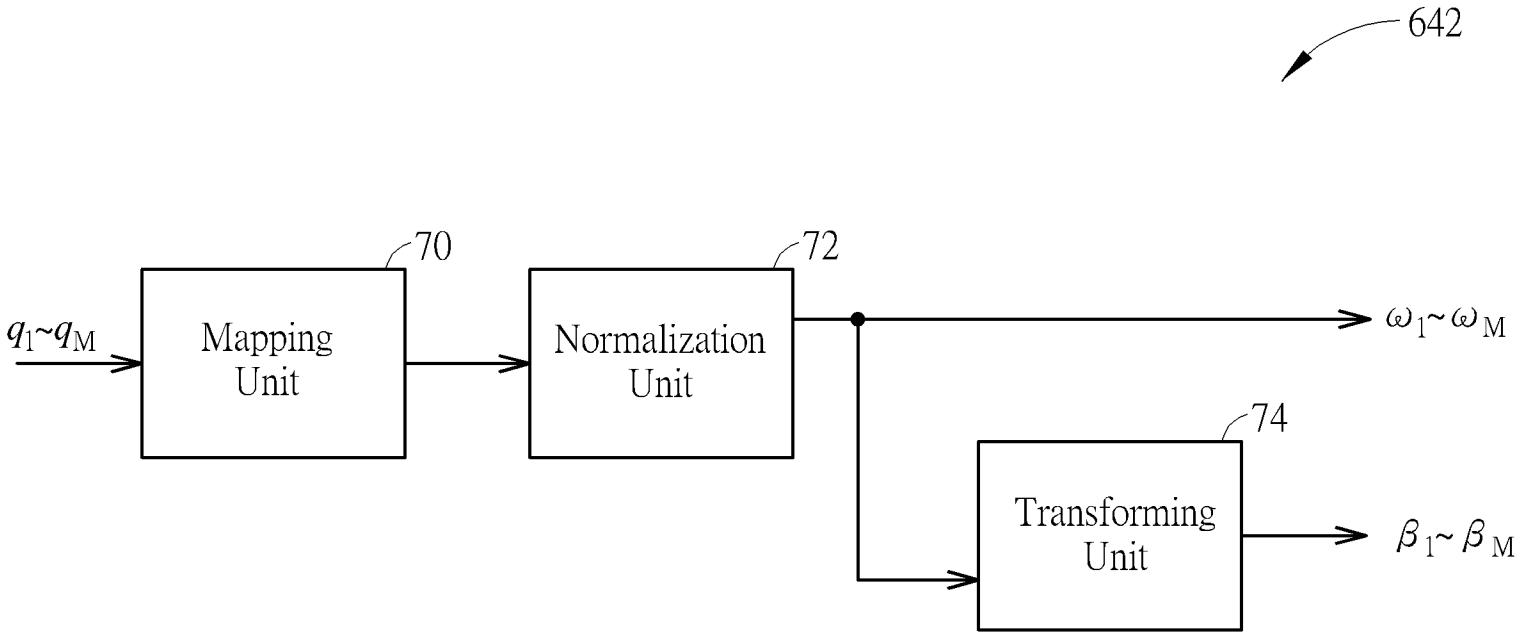
FIG. 7 is a schematic diagram of an update controller according to an embodiment of the present invention.

In detail, FIG. 6 and FIG. 7 are schematic diagrams of a constraint generator 64 and an update controller 642 according to an embodiment of the present invention. The constraint generator 64 may generate the mask constraint $\Lambda$ according to the separated results $y_1$-$y_M$ and the recognition scores $q_1$-$q_M$, which comprises the update controller 642, an energy unit 60, a weighted energy generator 62, a reference energy generator 68 and a mask generator 66. The update controller 642 comprises a mapping unit 70, a normalization unit 72 and a transforming unit 74. The energy unit 60 receives the separated results $y_1$-$y_M$ and computes audio source energies $P_1$-$P_M$ corresponding to the separated results $y_1$-$y_M$ (also corresponding to the audio sources $z_1$-$z_M$). The update controller 642 generates the weightings $\omega_1$-$\omega_M$ and weightings $\beta_1$-$\beta_M$ according to the recognition scores $q_1$-$q_M$. The weighted energy generator 62 generates a weighted energy $P_{wei}$ according to the weightings $\omega_1$-$\omega_M$ and the audio source energies $P_1$-$P_M$. The reference energy generator 68 generates a reference energy $P_{ref}$ according to the weightings $\beta_1$-$\beta_M$ and the audio source energies $P_1$-$P_M$. The mask generator 66 generates the mask constraint $\Lambda$ according to the weightings $\omega_1$-$\omega_M$, the weighted energy $P_{wei}$ and the reference energy $P_{ref}$.

Specifically, the weighted energy generator 62 may generate the weighted energy $P_{wei}$ as $$P_{wei} = \sum_{m=1}^{M} \omega_m P_m.$$

The reference energy generator 68 may generate the reference energy $P_{ref}$ as $$P_{ref} = \sum_{m=1}^{M} \beta_m P_m.$$

The mapping unit 70 and the normalization unit 72 comprised in the update controller 642 are the same as the mapping unit 40 and the normalization unit 42, which are not narrated further herein. In addition, the transforming unit 74 may transform the weightings $\omega_1$-$\omega_M$ into the weightings $\beta_1$-$\beta_M$, Method of the transforming unit 74 generating the weightings $\beta_1$-$\beta_M$ is not limited. For example, the transforming unit 74 may generate/transform the weightings $\beta_M$ as $\beta_m=1-\omega_m$, which is not limited thereto.

On the other hand, the mask generator 66 may generate the specific value G in the mask constraint Λ according to the weighted energy $P_{wei}$ and the reference energy $P_{ref}$. For example, the mask generator 66 may compute the specific value G as $$G=\begin{cases}1, & P_{wei}>\gamma P_{ref}\\ 0, & P_{wei}\le\gamma P_{ref}\end{cases},$$

where the ratio γ may be adjusted according to practical situation. In addition, the mask generator 66 may compute the specific value G as $G=P_{wei}/P_{ref}$ or $G=P_{wei}/(P_{ref}+P_{wei})$, and not limited thereto. In addition, the mask generator 66 may determine the target index n* of the target signal according to the weightings $\omega_1$-$\omega_M$ (i.e., according to the recognition scores $q_1$-$q_M$) . For example, the mask generator 66 may determine the target index n* as an index corresponding to a maximum weighting among the weightings $\omega_1$-$\omega_M$, i.e., the target index n* may be expressed as $n^*=\arg_m \max \omega_m$. Thus, after obtaining the specific value G and the target index n*, the mask generator 66 may generate the mask constraint Λ as $$[\Lambda]_{i,i}=\begin{cases}G, & i=n^*\\ 1-G, & i\ne n^*\end{cases}.$$

The constraint generator 64 may deliver the mask constraint Λ to the demixing matrix generator 16, and the demixing matrix generator 16 may generate the renewed demixing matrix W according to the mask constraint Λ, so as to separate the audio sources $z_1$-$z_M$ more properly.

Figure 8:
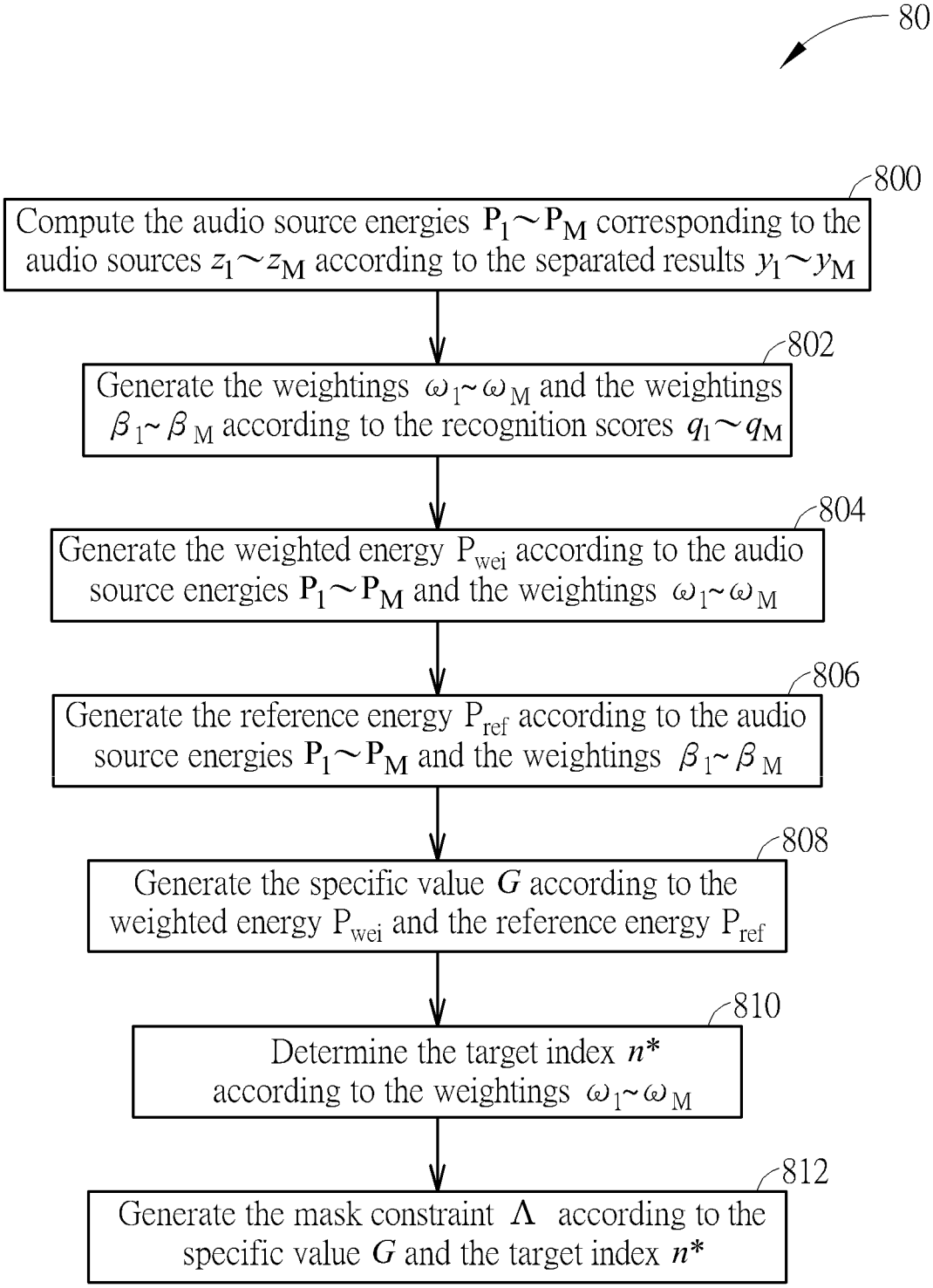
FIG. 8 is a schematic diagram of a mask constraint generation process according to an embodiment of the present invention.

Operations of the constraint generator 64 may be summarized as a mask constraint generation process 80. As shown in FIG. 8, the mask constraint generation process 80 comprises the following steps:

Step 800: Compute the audio source energies $P_1$-$P_M$ corresponding to the audio sources $z_1$-$z_M$ according to the separated results $y_1$-$y_M$.

Step 802: Generate the weightings $\omega_1$-$\omega_M$ and the weightings $\beta_1$-$\beta_M$ according to the recognition scores $q_1$-$q_M$.

Step 804: Generate the weighted energy $P_{wei}$ according to the audio source energies $P_1$-$P_M$ and the weightings $\omega_1$-$\omega_M$.

Step 806: Generate the reference energy $P_{ref}$ according to the audio source energies $P_1$-$P_M$ and the weightings $\beta_1$-$\beta_M$.

Step 808: Generate the specific value G according to the weighted energy $P_{wei}$ and the reference energy $P_{ref}$.

Step 810: Determine the target index n* according to the weightings $\omega_1$-$\omega_M$.

Step 812: Generate the mask constraint Λ according to the specific value G and the target index n*.

Figure 9:
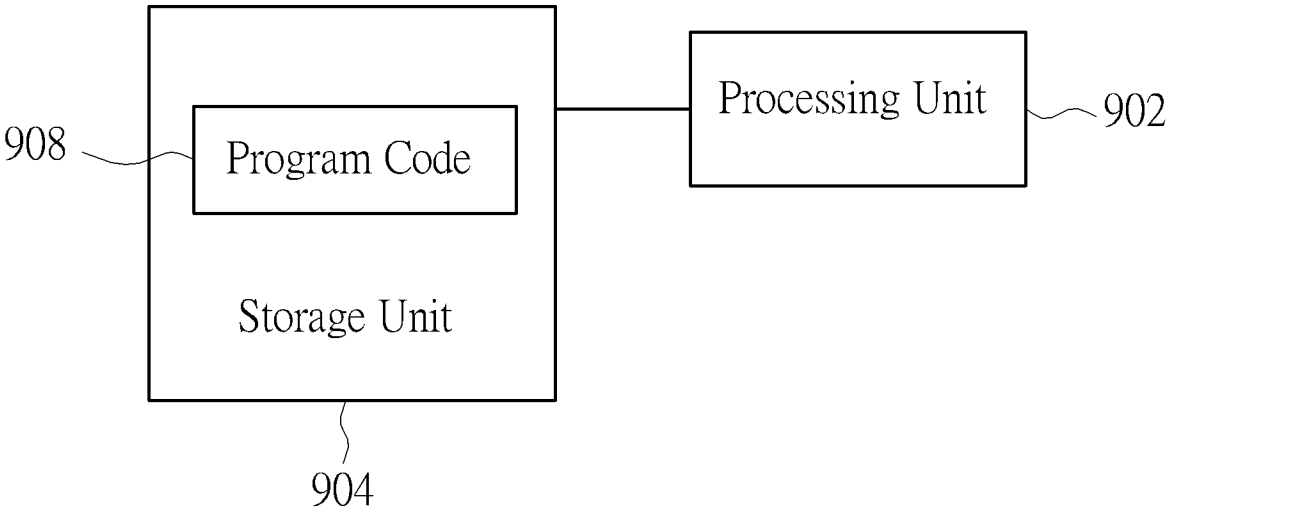
FIG. 9 is a schematic diagram of an audio source separation device according to an embodiment of the present invention.

In another perspective, the audio separation device is not limited to be realized by ASIC. FIG. 9 is a schematic diagram of an audio source separation device 90 according to an embodiment of the present invention. The audio separation device 90 comprises a processing unit 902 and a storage unit 904. The audio source separation process 20, the spatial constraint generation process 50, the mask constraint generation process 80 stated in the above may be compiled as a program code 908 stored in the storage unit 904, to instruct the processing unit 902 to execute the processes 20, 50 and 80. The processing unit 902 may be a digital signal processor (DSP), and not limited thereto. The storage unit 904 may be a non-volatile memory (NVM), e.g., an electrically erasable programmable read only memory (EEPROM) or a flash memory, and not limited thereto.

In addition, to be more understandable, a number of M is used to represent the numbers of the audio sources z, the target signal s, the receivers R, or other types of output signals (such as the audio source energies P, the recognition scores q, the separated results y, etc.) in the above embodiments. Nevertheless, the numbers thereof are not limited to be the same. For example, the numbers of the receivers R, the audio sources z, and the target signal s, may be 2, 4, and 1, respectively.

In summary, the present invention is able to update the constraint according to the scores, and adjust the demixing matrix according to the updated constraint, which may be adaptive to the spatial variation of the target signal(s) , so as to separate the audio sources $z_1$-$z_M$ more properly.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A method of audio source separation, configured to separate audio sources from a plurality of received signals, the method comprising:

applying a demixing matrix on the plurality of received signals to generate a plurality of separated results;

performing a recognition operation on the plurality of separated results to generate a plurality of recognition scores, wherein the plurality of recognition scores are related to matching degrees between the plurality of separated results and a target signal;

generating a constraint according to the plurality of recognition scores, wherein the constraint is a spatial constraint or a mask constraint; and adjusting the demixing matrix according to the constraint;

wherein the adjusted demixing matrix is applied to the plurality of received signals to generate a plurality of updated separated results from the plurality of received signals;

wherein the method of audio source separation is utilized for speech recognition.

2. The method of claim 1, wherein the step of performing the recognition operation on the plurality of separated results to generate the plurality of recognition scores comprises:

establishing a reference model corresponding to the target signal;

extracting features of the separated results; and comparing the features of the separated results with the reference model to generate the plurality of recognition scores.

3. The method of claim 1, wherein the step of generating the spatial constraint according to the plurality of recognition scores comprises:

generating a plurality of first weightings according to the plurality of recognition scores;

generating an update rate according to the plurality of recognition scores;

generating an update coefficient according to the demixing matrix and the plurality of first weightings; and generating the spatial constraint according to the update coefficient and the update rate.

4. The method of claim 3, wherein the step of generating the plurality of first weightings according to the plurality of recognition scores comprises:

performing a mapping operation on the plurality of recognition scores, to obtain a plurality of mapping values; and performing a normalization operation on the plurality of mapping values, to obtain the plurality of first weightings.

5. The method of claim 4, wherein the step of generating the update rate according to the plurality of recognition scores comprises:

obtaining the update rate as a maximum value of the plurality of mapping values.

6. The method of claim 3, wherein the step of generating the update coefficient according to the demixing matrix and the plurality of first weightings comprises:

performing a matrix inversion operation on the demixing matrix, to generate a plurality of estimated steering vectors; and generating the update coefficient according to the plurality of estimated steering vectors and the plurality of first weightings.

7. The method of claim 3, wherein the step of generating the spatial constraint according to the update coefficient and the update rate comprises:

executing $c=(1-\alpha)c+\alpha c_{update}$;

wherein c represents the spatial constraint, $\alpha$ represents the update rate, $c_{update}$ represents the update coefficient.

8. The method of claim 1, wherein the step of generating the mask constraint according to the plurality of recognition scores comprises:

generating a plurality of first weightings according to the plurality of recognition scores;

generating a plurality of second weightings according to the plurality of first weightings;

generating a plurality of audio source energies according to the separated results;

generating a weighted energy according to the plurality of audio source energies and the plurality of first weightings;

generating a reference energy according to the plurality of audio source energies and the plurality of second weightings; and generating the mask constraint according to the weighted energy, the reference energy and the plurality of first weightings.

9. The method of claim 8, wherein the step of generating the mask constraint according to the weighted energy, the reference energy and the plurality of first weightings comprises:

generating a specific value according to the weighted energy and the reference energy;

determining an target index according to the plurality of first weightings; and generating the mask constraint according to the specific value and the target index.

10. The method of claim 9, wherein the step of determining the target index according to the plurality of first weightings comprises determining the target index as an index corresponding to a maximum weighting among the plurality of first weightings.

11. An audio separation device, configured to separate audio sources from a plurality of received signals, the audio separation device comprising:

a separation unit, for applying a demixing matrix on the plurality of received signals to generate a plurality of separated results;

a recognition unit, for performing a recognition operation on the plurality of separated results to generate a plurality of recognition scores, wherein the plurality of recognition scores are related to matching degrees between the plurality of separated results and a target signal;

a constraint generator, for generating a constraint according to the plurality of recognition scores, wherein the constraint is a spatial constraint or a mask constraint; and a demixing matrix generator, for adjusting the demixing matrix according to the constraint;

wherein the adjusted demixing matrix is applied to the plurality of received signals to generate a plurality of updated separated results from the plurality of received signals;

wherein the audio separation device is utilized for speech recognition.

12. The audio separation device of claim 11, wherein the recognition unit comprises:

a reference model trainer, for establishing a reference model corresponding to the target signal;

a feature extractor, for extracting features of the separated results; and a matcher, for comparing the features of the separated results with the reference model to generate the plurality of recognition scores.

13. The audio separation device of claim 11, wherein the constraint generator comprises:

a matrix inversion unit, for performing a matrix inversion operation on the demixing matrix, to generate a plurality of estimated steering vectors;

a first update controller, for generating a plurality of first weightings according to the plurality of recognition scores, generating an update rate according to the plurality of recognition scores, and generating an update coefficient according to the demixing matrix and the plurality of first weightings; and an average unit, for generating the spatial constraint according to the update coefficient and the update rate.

14. The audio separation device of claim 13, wherein the first update controller comprises:

a mapping unit, for performing a mapping operation on the plurality of recognition scores, to obtain a plurality of mapping values; and a normalization unit, for performing a normalization operation on the plurality of mapping values, to obtain the plurality of first weightings.

15. The audio separation device of claim 14, wherein the first update controller comprises:

a maximum selector, for obtaining the update rate as a maximum value of the plurality of mapping values.

16. The audio separation device of claim 13, wherein the first update controller comprises:

a weighting combining unit, for generating the update coefficient according to the plurality of estimated steering vectors and the plurality of first weightings.

17. The audio separation device of claim 13, wherein the average unit executes $$c=(1-\alpha)c+\alpha c_{update};$$

wherein c represents the spatial constraint, $\alpha$ represents the update rate, $c_{update}$ represents the update coefficient.

18. The audio separation device of claim 11, wherein the constraint generator comprises:

a second update controller, for generating a plurality of first weightings according to the plurality of recognition scores, and generating a plurality of second weightings according to the plurality of first weightings;

an energy unit, for generating a plurality of audio source energies according to the separated results;

a weighted energy generator, for generating a weighted energy according to the plurality of audio source energies and the plurality of first weightings;

a reference energy generator, for generating a reference energy according to the plurality of audio source energies and the plurality of second weightings; and a mask generator, for generating the mask constraint according to the weighted energy, the reference energy and the plurality of first weightings.

19. The audio separation device of claim 18, wherein the mask generator is further configured to perform the following step, for generating the mask constraint according to the weighted energy, the reference energy and the plurality of first weightings:

generating a specific value according to the weighted energy and the reference energy;

determining an target index according to the plurality of first weightings; and generating the mask constraint according to the specific value and the target index.

20. The audio separation device of claim 19, wherein the mask generator is further configured to perform the following step, for determining the target index according to the plurality of first weightings:

determining the target index as an index corresponding to a maximum weighting among the plurality of first weightings.

* * * * *